US007686625B1

(12) United States Patent
Dyer et al.

(10) Patent No.: US 7,686,625 B1
(45) Date of Patent: Mar. 30, 2010

(54) GROUNDING CLIP

(75) Inventors: Jacob M. Dyer, Marysville, PA (US); Matthew Edward Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 10 days.

(21) Appl. No.: 12/266,578

(22) Filed: Nov. 7, 2008

(51) Int. Cl.
*H01R 4/66* (2006.01)

(52) U.S. Cl. ..... 439/92; 439/907; 439/857

(58) Field of Classification Search ..... 439/857, 439/92, 907, 65, 66, 74
See application file for complete search history.

(56) References Cited

U.S. PATENT DOCUMENTS

| | | | | |
|---|---|---|---|---|
| 3,122,604 | A | 2/1964 | Cook et al. | |
| 3,546,664 | A * | 12/1970 | De Bolt et al. | 439/907 |
| 4,029,384 | A | 6/1977 | Reinwall, Jr. | |
| D251,192 | S | 2/1979 | De Luca | |
| 4,993,959 | A | 2/1991 | Randolph | |
| 5,104,332 | A * | 4/1992 | McCoy | 439/907 |
| 5,451,167 | A | 9/1995 | Zielinski et al. | |
| 5,480,310 | A | 1/1996 | Baum | |
| 6,106,310 | A | 8/2000 | Davis et al. | |
| 6,216,321 | B1 | 4/2001 | Bakker et al. | |
| 6,276,947 | B1 | 8/2001 | Homfeldt et al. | |
| D459,302 | S | 6/2002 | Malin | |

OTHER PUBLICATIONS

Tyco Electronics, Customer Drawing regarding Grounding Clip, Apr. 11, 2007.

Tyco Electronics, "Grounding Clip Terminals with "F" Crimp Feature," Application Specification 114-13095, Mar. 6, 2007, Rev. B.

* cited by examiner

*Primary Examiner*—Tho D Ta

(57) ABSTRACT

The invention is directed to a grounding clip which can provide an electrical connection between a ground wire, a first panel and a second panel. The grounding clip has a wire terminating section for terminating a grounding wire thereto, a first panel receiving portion for terminating a first panel therein, and a second panel receiving portion for terminating a second panel therein.

18 Claims, 9 Drawing Sheets

GROUNDING CLIP

FIELD OF THE INVENTION

The present invention is directed to a one piece grounding clip for use in establishing an interconnection between a conductor and two conductive panels.

BACKGROUND OF THE INVENTION

Grounding clips are known generally and used widely, for example to fasten electrical conductors or wires to conductive appliance panels while providing an electrical contact therebetween. Known grounding clips comprise generally a U-shaped panel contact section, and a wire contact section disposed adjacent to a curved portion or bight of the panel contact section opposite an open end thereof. In other grounding clips, the wire contact section extends axially from the bight of the clip. It is known also to provide one or more barbs protruding from inner sides of the panel contact section to provide improved electrical contact with the panel.

Examples of known grounding clips include the grounding clip shown and described in U.S. Pat. No. 4,993,959 entitled "Grounding Clip". This grounding clip has a stamped and formed member having a U shaped section with opposed walls extending from a bight for engagement with a panel. Tines or serrations are struck inwardly from each wall to grip the panel. A wire contact section is offset from the U-shaped panel. A centrally disposed strain relief arm extends from the U-shaped section, and any force transmitted from the wire to the clip is in the form of a straight pull extending through the centrally disposed strain relief arm.

U.S. Pat. No. 6,106,310 discloses a panel-grounding contact which includes a wire-connecting section and a panel-connecting section which has a deep U-shaped channel between walls. The walls include opposed pairs of teeth which extend toward the channel bottom and which are staggered inwardly from the channel entrance. The points of the teeth are adapted to scrape away corrosion layers of a conductive panel during mounting of the grounding clip onto an edge thereof as well as to secure the contact on the panel. The wire-connecting section extends orthogonally with respect to the panel edge after mounting of the clip onto the panel.

U.S. Pat. No. 6,276,947 discloses a grounding clip having a generally U-shape spring clamp which has first and second opposing walls which extend from a curved base portion thereof. The first and second walls each having a leading edge portion opposite the curved base portion. The spring clamp is fastened to a panel with the curved base portion disposed over the panel edge, the first wall of the spring clamp adjacent one side of the panel and the second wall thereof adjacent the other side of the panel. A wire fastening member, preferably the crimping type, extends from first wall of the spring clamp between the curved base portion of the spring clamp and the leading edge portion thereof. When the spring clamp is fastened to the panel, the wire fastening member and wire fastened thereto are adjacent the corresponding side of the panel and spaced apart from the panel edge, whereby only the curved base portion of the grounding clip protrudes beyond the panel edge.

Other grounding clips are shown in Tyco Electronics Application Specification 114-13095 (2006 Mar. 7 Rev B) entitled "Grounding Clip Terminals with 'F.' Crimp Features". Although all the prior art grounding clips recited above fasten electrical conductors or wires to conductive panels while providing an electrical contact therebetween, their use is limited to instances in which one or more wires are ground to one panel. In instances in which a wire is to be electrically ground to more than one panel (i.e. ballast can and ballast lid), another grounding clip must be used. It is, therefore, desired to provide a one piece ground clip which is capable of grounding the conductor(s) to more than one conductive panel.

SUMMARY OF THE INVENTION

The invention is directed to a grounding clip which can provide an electrical connection between a ground wire, a first panel and a second panel. The grounding clip has a wire terminating section for terminating a grounding wire thereto, a first panel receiving portion for terminating a first panel therein, and a second panel receiving portion for terminating a second panel therein.

The first panel receiving portion may have a first outside wall and an oppositely facing inside wall. The outside wall and the inside wall extend from a first bight portion. The second panel receiving portion may have a second outside wall and the same oppositely facing inside wall as the first panel receiving portion. The second outside wall and the inside wall extend from a second bight portion. The first bight portion may extend from a first edge of the inside wall, and the second bight portion may extend from an oppositely facing second edge of the inside wall. The inside wall may have a connecting portion which extends between the first panel receiving portion and the second panel receiving portion. The wire terminating section, the first panel receiving portion and the second panel receiving portion conduct current thereacross to provide grounding between components electrically connected to the wire terminating section, the first panel receiving portion and the second panel receiving portion.

Tines may extend inwardly from proximate edges of the first outside wall and the second outside wall. The tines may also extend inwardly from proximate edges of the inside wall. The tines are inclined inwardly relative to the respective first outside wall and the second outside wall and extend toward the respective first bight portion and second bight portion. The tines have sharp points to facilitate making an electrical connection with a respective first panel and a respective second panel when the first panel is inserted into the first panel receiving portion and the second panel is inserted into the second panel receiving portion.

The wire terminating section may extend from the first outside wall of the first panel receiving portion. A transition section may be provided on the wire terminating section to space a crimp section of the wire terminating section from the first outside wall.

The invention provides the advantage of having a one piece grounding clip which can be used to ground two or more panels. Consequently, grounding of the panels is simplified, as multiple grounding clips need not be used.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 4:
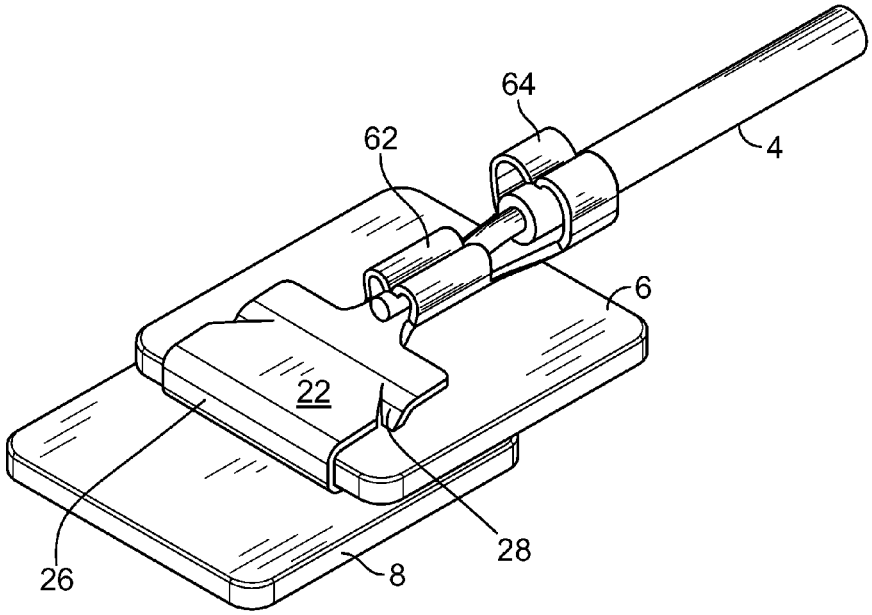
FIG. 4 is a top perspective view of the grounding clip of FIG. 1 showing a wire and panels terminated thereto.
Figure 11:
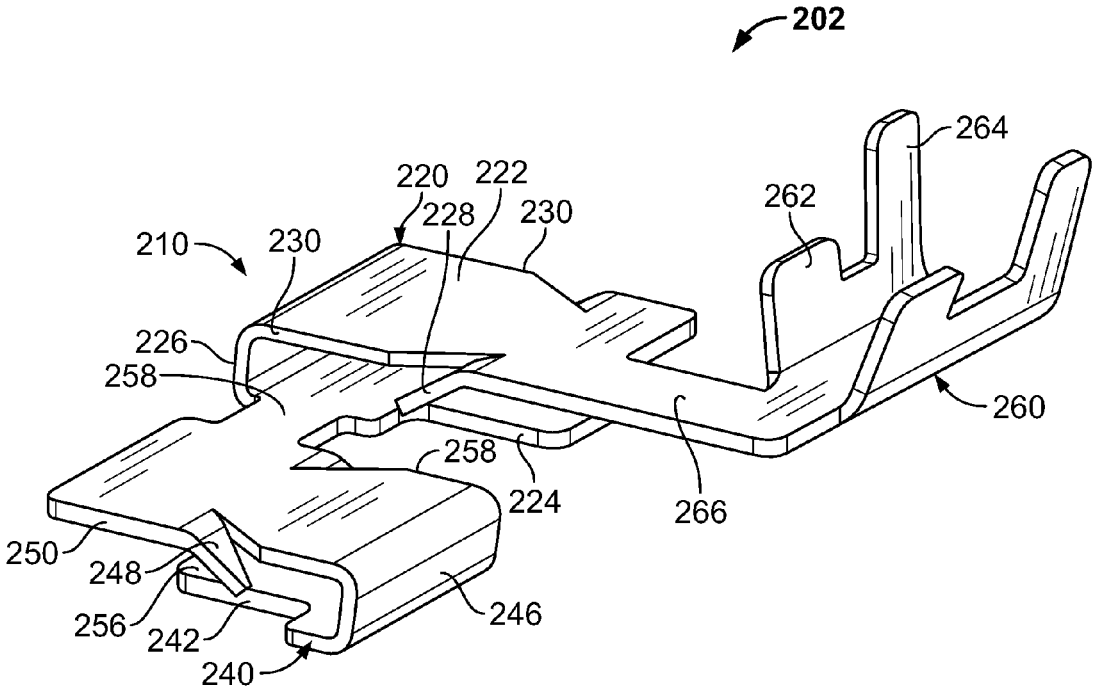
FIG. 11 is a top perspective view of a second alternate embodiment of a grounding clip of the present invention.

The grounding clips 2, 102, 202 are intended to provide an electrical interconnection between a ground wire 4, a first panel 6 and a second panel 8 (as best shown in FIGS. 4 and 11). The grounding clips 2, 102, 202 are stamped and formed from a conventional spring metal such as stainless steel or tin plated phosphor bronze or any other material that has the resilient and electrical characteristics required to conduct current thereacross and to properly engage the components, thereby providing grounding between the ground wire 4, the first panel 6 and the second panel 8. In the embodiment shown, the grounding clips 2, 102, 202 are intended for use with 18 gauge wires, although grounding clips of this type could be used for other wire sizes. The grounding clips 2, 102, 202 are suitable for use with a plurality of different panels having different thicknesses and formed of different materials. In particular, the same grounding clip could be used to establish an interconnection to 0.022 inch thick aluminum panels, 0.024 inch thick painted steel panels and/or 0.033 inch galvanized steel panels. It should be understood that grounding clips according to this invention can be fabricated in different sizes and could be employed with panels having more or less thickness and fabricated of different conductive materials.

Figure 1:
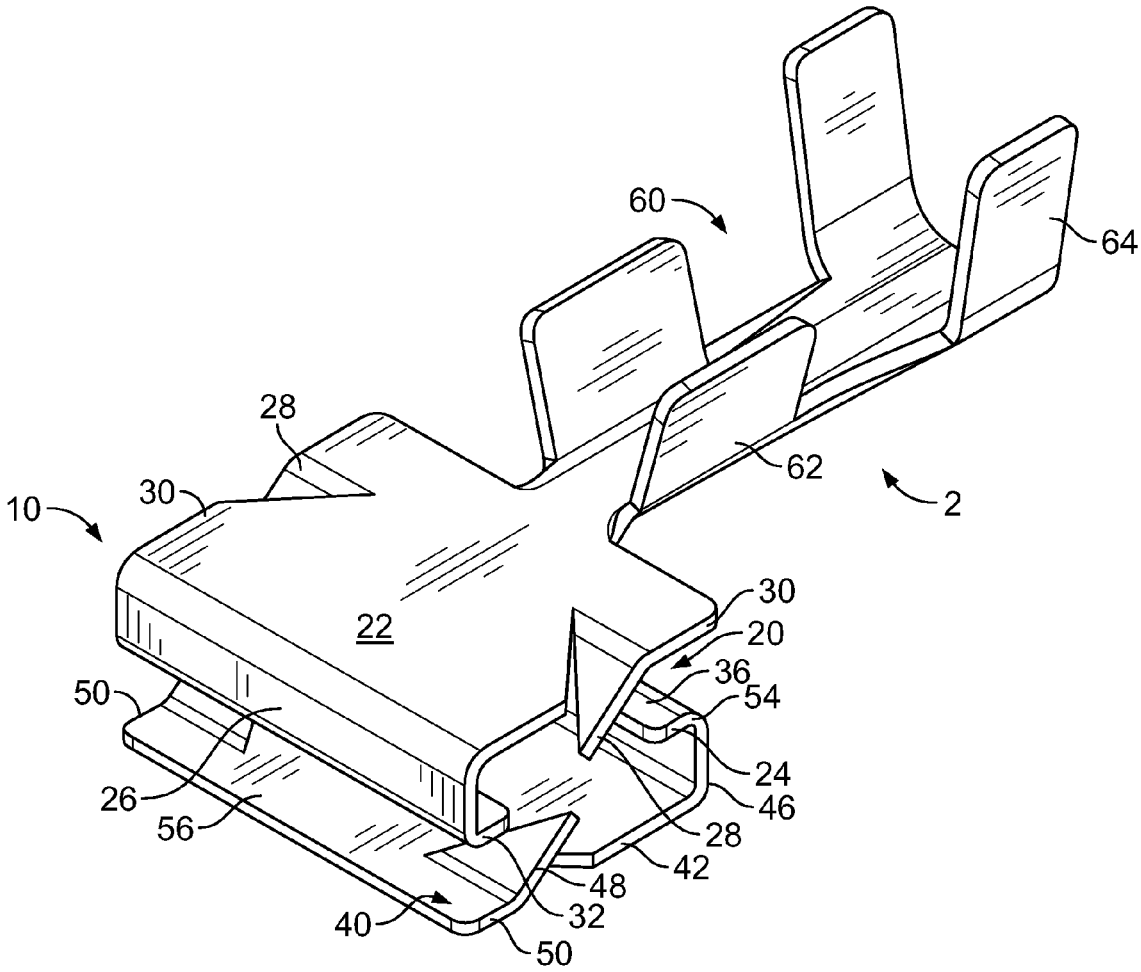
FIG. 1 is a top perspective view of an embodiment of a grounding clip of the present invention.
Figure 2:
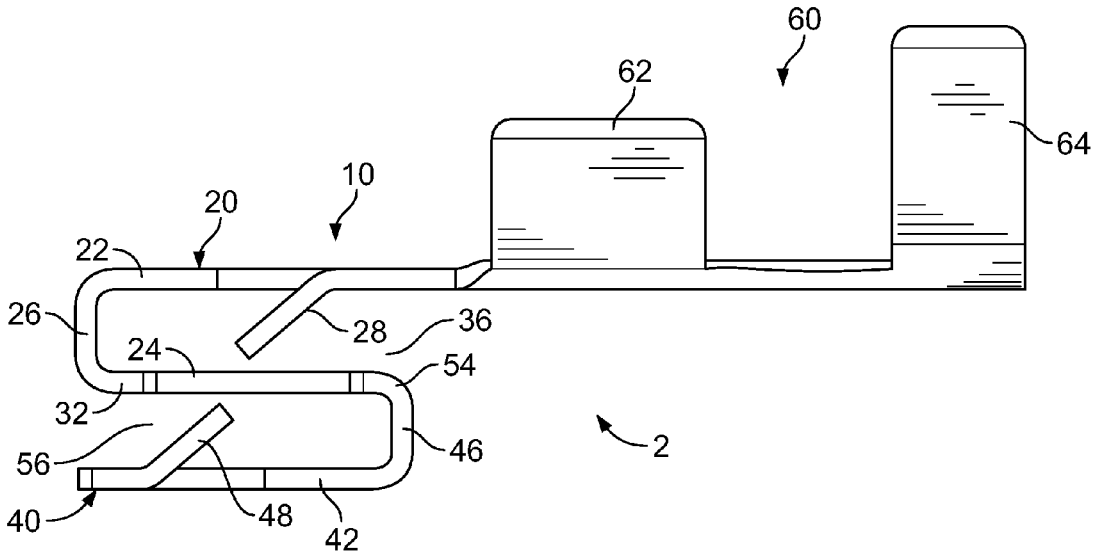
FIG. 2 is a side view of the grounding clip of FIG. 1.

Referring to FIGS. 1 and 2, grounding clip 2 has a generally S-shaped panel terminating or contact section 10 and a wire terminating or contact section 60. The S-shaped panel contact section 10 has a first panel receiving portion 20 and a second panel receiving portion 40. The first panel receiving portion 20 has a pair of oppositely facing walls 22 and 24 extending from a central bight 26. Both electrical and mechanical interconnection to the first panel 6 is established by tines or serrations 28 formed inwardly along the edges 30 of wall 22 of the first panel receiving section 20. These tines or serrations 28 protrude inwardly from the wall 22 and form an inclined gripping engagement with the first panel 6. Each tine 28 is inclined inwardly relative to the wall 22 and extends toward the bight 26. The tines 28 have a greater retention force when subjected to a straight pull exerted on the first panel receiving portion 20 than when subjected to a force tending to impart rotation to the first panel receiving portion 20. The tines or serrations 28 have sharp points which facilitate digging into the first panel 6. Since the tines 28 are inclined towards the bight 26, the first panel receiving portion 20 can be inserted onto the edge of the first panel 6. During insertion the tines or serrations 28 will be deflected inwardly. It can readily be seen that it would require a greater extraction force to remove the first panel receiving portion 20 from the first panel 6 than the force required to insert the first panel receiving portion 20 onto the first panel 6.

The second panel receiving portion 40 has a pair of oppositely facing walls 42 and 24 extending from a central bight 46. Both electrical and mechanical interconnection to the second panel 8 is established by tines or serrations 48 formed inwardly along the edges 50 of wall 42 of the second panel receiving section 40. These tines or serrations 48 protrude inwardly from the wall 42 and form an inclined gripping engagement with the second panel 8. Each tine 48 is inclined inwardly relative to the wall 42 and extends toward the bight 46. The tines 48 have a greater retention force when subjected to a straight pull exerted on the second panel receiving portion 40 than when subjected to a force tending to impart rotation to the second panel receiving portion 40. The tines or serrations 48 have sharp points which facilitate digging into the second panel 8. Since the tines 48 are inclined towards the bight 46, the second panel receiving portion 40 can be inserted onto the edge of the second panel 8. During insertion the tines or serrations 48 will be deflected inwardly. It can readily be seen that it would require a greater extraction force to remove the second panel receiving portion 40 from the second panel 8 than the force required to insert the second panel receiving portion 40 onto the second panel 8.

As is best shown in FIG. 2, the first panel receiving portion 20 and the second panel receiving section 40 have wall 24 in common. Bight 26 extends from a first edge 32 of the wall 24. The open end of the first panel receiving recess 36 is formed in the first panel receiving portion 20 opposite the bight 26. Bight 46 extends from a second edge 54 of the wall 24. The open end of the second panel receiving recess 56 is formed in the second panel receiving portion 40 opposite the bight 46. As best shown in FIGS. 1 and 2, the open end of the first panel receiving recess 36 and the open end of the second panel receiving recess 56 face in opposite directions. Although the open ends face in opposite directions in the embodiment shown, other configurations are possible without departing from the scope of the invention.

Figure 3:
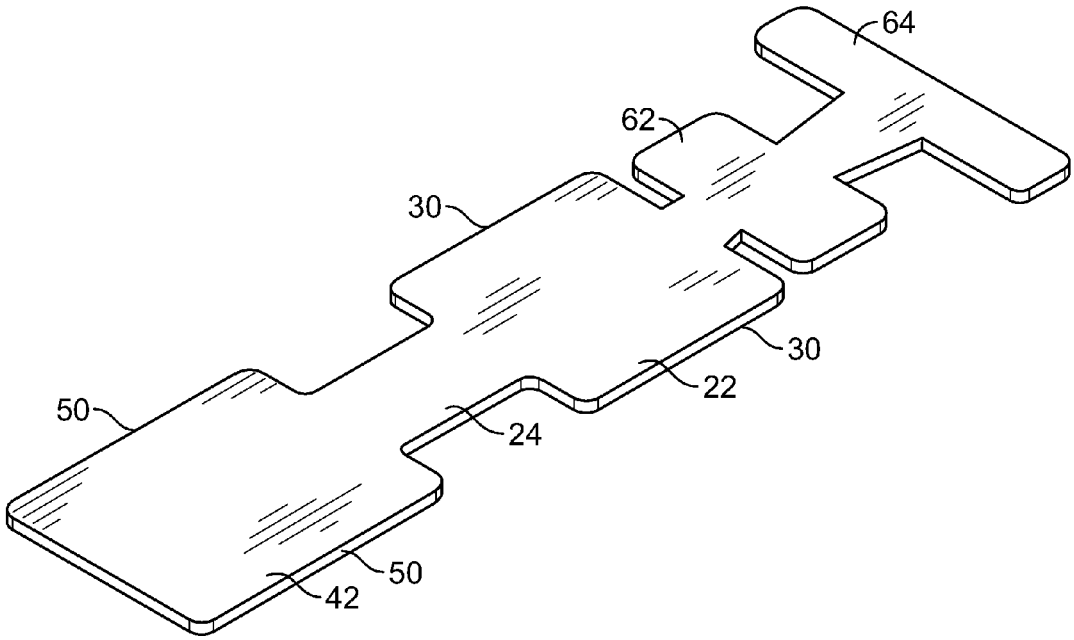
FIG. 3 is a top perspective view of blank of the grounding clip of FIG. 1 prior to forming.

As best shown in FIGS. 1 through 3, the wire contact section 60 extends from the wall 22 of the first panel receiving portion 20. The wire contact section 60 has a crimp section 62 with a strain relief section 64 of conventional construction suitable for establishing an electrical connection to the stripped end of an insulated wire 4. In this embodiment, the longitudinal axis of the contact section 60 is essentially perpendicular to the longitudinal axis of the bight 26. No portion of the wire contact section 60 extends into the extended space of the first panel receiving recess 36. Consequently, as shown in FIG. 4, neither the wire contact section 60 nor the wire 4 will interfere with the insertion of the first panel 6 into the first panel receiving recess 36.

Figure 5:
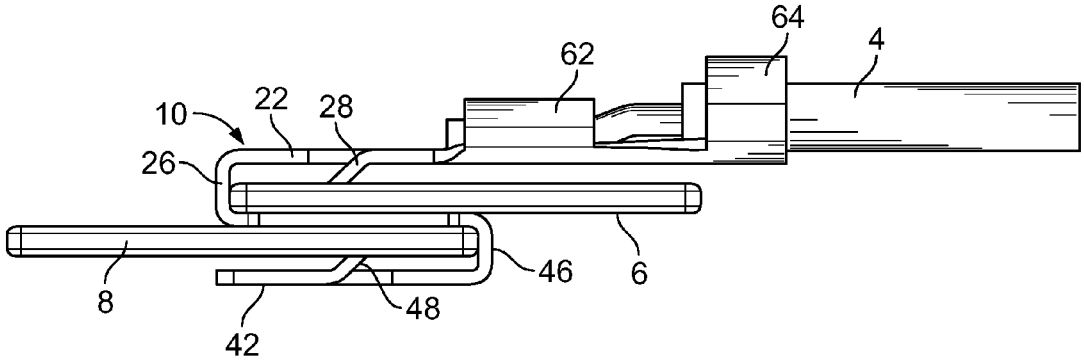
FIG. 5 is a side view of the grounding clip of FIG. 2 showing a wire and panels terminated thereto.

Referring to FIGS. 4 and 5, the ground wire 4, the first panel 6 and the second panel 8 are positioned in electrical engagement with the grounding clip 2. Crimp section 62 is crimped to the ground wire 4, placing the grounding clip 2 in electrical engagement with the ground wire 4. Strain relief section 64 engages the ground wire 4 to provide a strain relief to the ground wire 4. The tines 28, 48 engage the panels 6, 8 respectively to provide a grounding path therebetween. As the panels 6, 8 are inserted into the grounding clips 2, the tines 28, 48 will exert pressure on the surfaces of the panels 6, 8 thereby providing a wiping action as the insertion occurs to remove any contamination or corrosion on the surfaces of the panels 6, 8. This provides a reliable electrical connection between the tines 28, 48 and the panels 6, 8.

Figure 6:
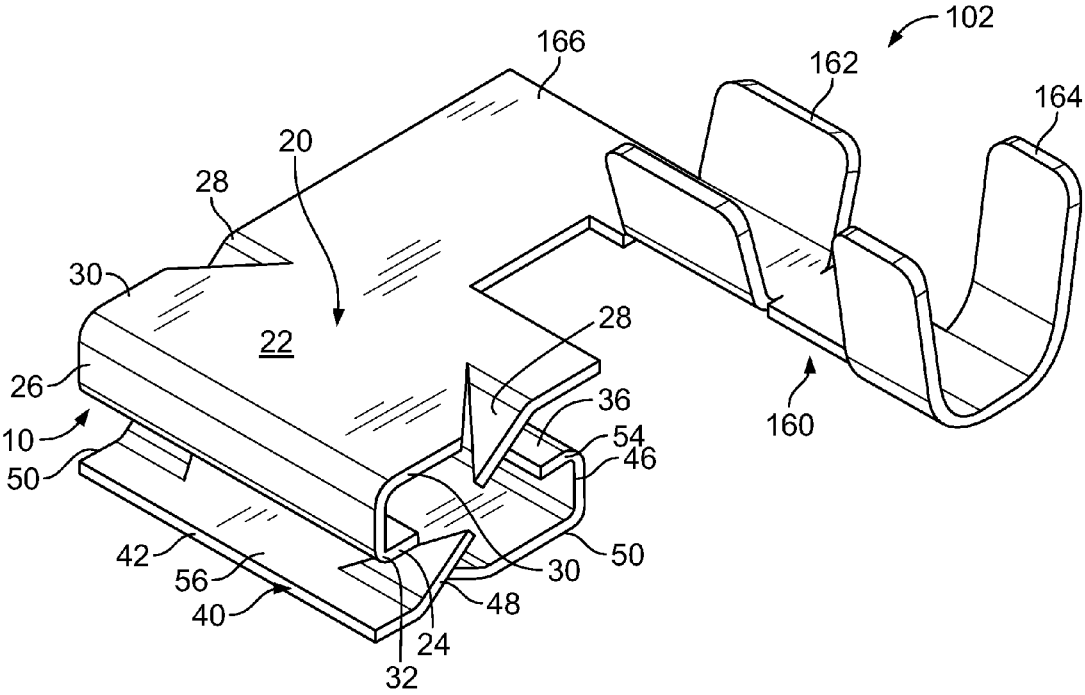
FIG. 6 is a top perspective view of a first alternate embodiment of a grounding clip of the present invention.
Figure 7:
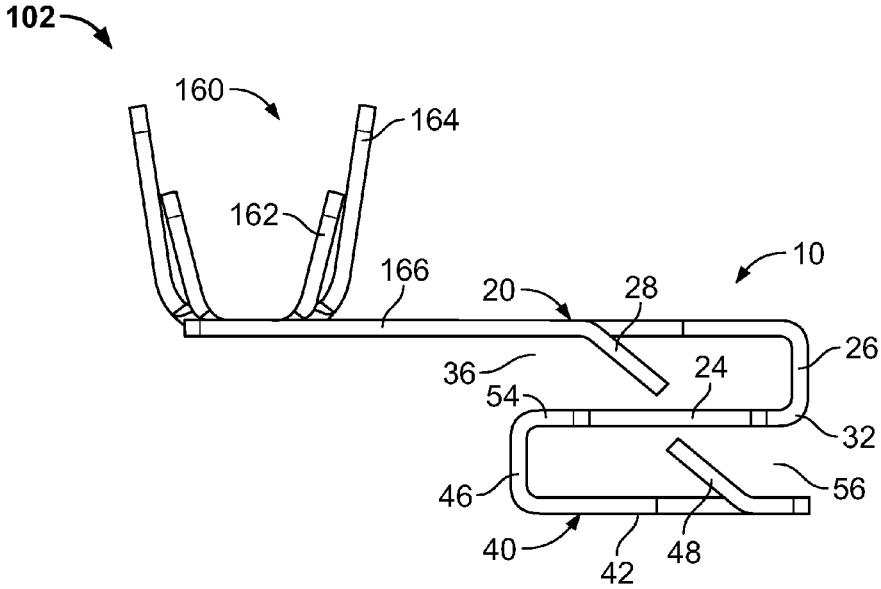
FIG. 7 is a side view of the grounding clip of FIG. 6.

Referring to FIGS. 6 and 7, grounding clip 102 has a generally S-shaped panel contact section 10 and a wire contact section 160. The S-shaped panel contact section 10 has a first panel receiving portion 20 and a second panel receiving portion 40. As the S-shaped panel contact section 10 is identical to that described for grounding clip 2, the detailed explanation will not be repeated. However, in FIGS. 6 through 10 the same numbers will be used to reference the same parts.

Figure 8:
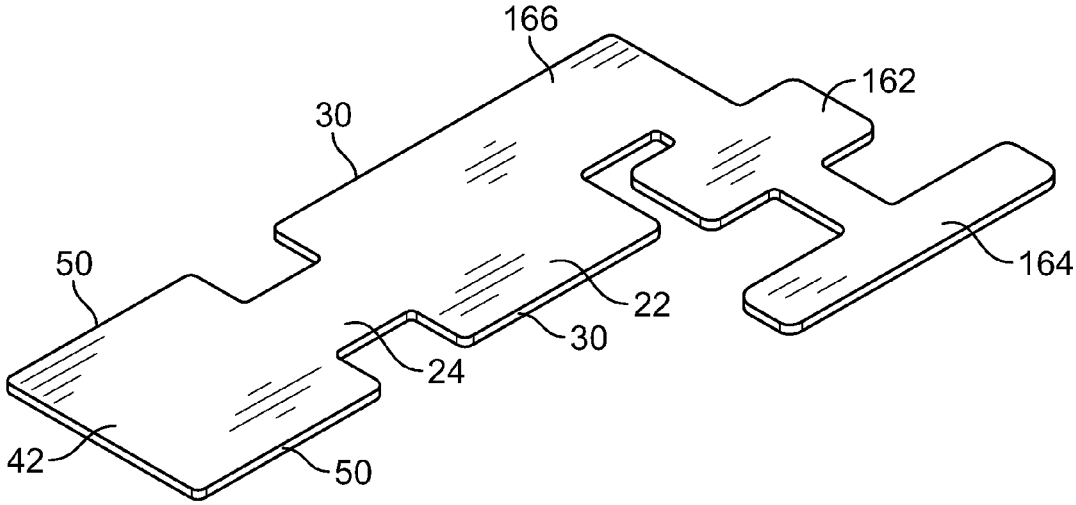
FIG. 8 is a top perspective view of blank of the grounding clip of FIG. 6 prior to forming.

As best shown in FIGS. 6 through 8, the wire contact section 160 extends from the wall 22 of the first panel receiving portion 20. The wire contact section 160 has a crimp section 162 with a strain relief section 164 of conventional construction suitable for establishing an electrical connection to the stripped end of an insulated wire 4. In this embodiment, the contact section 160 has a transition section 166 which extends from the wall 22 to the crimp section 162. The transition section 166 allows the crimp section 162 and the strain relief section 164 to be spaced from the wall 22. Additionally the transition section 166 allows the crimp section 162 and the strain relief section 164 to have their longitudinal axis positioned in a line which is essentially parallel to the longitudinal axis of the bight 26. This configuration is generally referred to as a right angled version. No portion of the wire contact section 160 extends into the extended space of the first panel receiving recess 36. Consequently, neither the wire contact section 160 nor the wire will interfere with the insertion of the first panel 6 into the first panel receiving recess 36.

Figure 9:
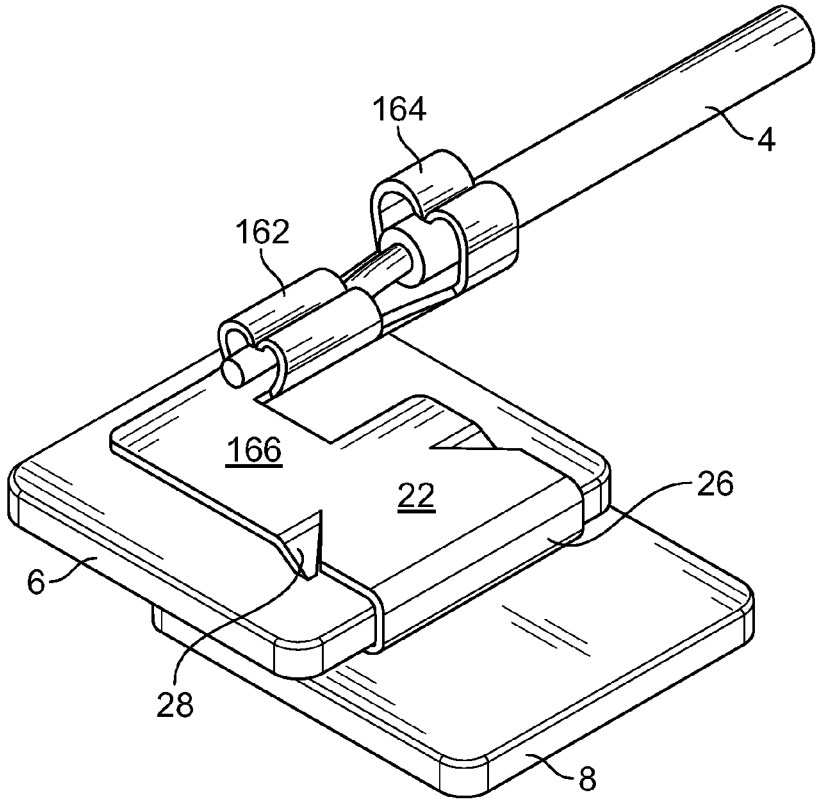
FIG. 9 is a top perspective view of the grounding clip of FIG. 6 showing a wire and panels terminated thereto.
Figure 10:
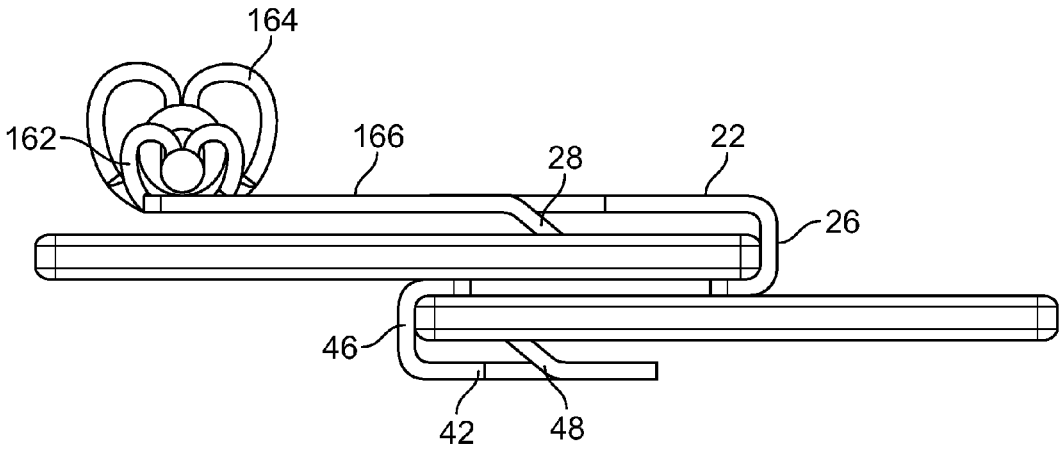
FIG. 10 is a side view of the grounding clip of FIG. 7 showing a wire and panels terminated thereto.

Referring to FIGS. 9 and 10, the ground wire 4, the first panel 6 and the second panel 8 are positioned in electrical engagement with the grounding clip 102. Crimp section 162 is crimped to the ground wire 4, placing the grounding clip 102 in electrical engagement with the ground wire 4. Strain relief section 164 engages the ground wire 4 to provide a strain relief to the ground wire 4. The tines 28, 48 engage the panels 6, 8 respectively to provide a grounding path therebetween. As the panels 6, 8 are inserted into the grounding clips 2, the tines 28, 48 will exert pressure on the surfaces of the panels 6, 8 thereby providing a wiping action as the insertion occurs to remove any contamination on the surfaces of the panels 6, 8. This provides a reliable electrical connection between the tines 28, 48 and the panels 6, 8.

Figure 12:
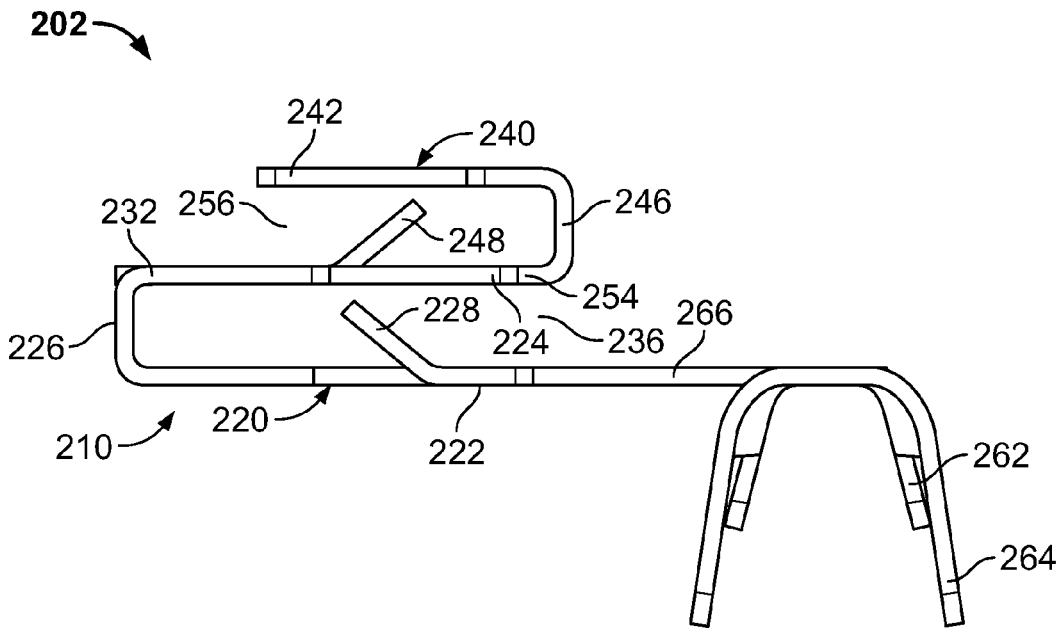
FIG. 12 is a side view of the grounding clip of FIG. 11.

Referring to FIGS. 11 and 12, grounding clip 202 has a panel contact section 210 and a wire contact section 260. The panel contact section 210 has a first panel receiving portion 220 and a second panel receiving portion 240. When viewed from the perspective of FIG. 12, the panel contact section 210 has a generally S-shaped configuration, however, as shown in FIG. 8, the first panel receiving portion 220 and the second panel receiving portion 240 are each generally U-shaped. The first panel receiving portion 220 and the second panel receiving portion 240 are staggered from each other and are connected by a connecting portion 258 of wall 224.

The first panel receiving portion 220 has a pair of oppositely facing walls 222 and 224 extending from a central bight 226. Both electrical and mechanical interconnection to the first panel 6 is established by tines or serrations 228 formed inwardly along the edges 230 of wall 224 of the first panel receiving section 220. These tines or serrations 228 protrude inwardly from the wall 224 and form an inclined gripping engagement with the first panel 6. Each tine 228 is inclined inwardly relative to the wall 224 and extends toward the bight 226. The tines 228 have a greater retention force when subjected to a straight pull exerted on the first panel receiving portion 220 than when subjected to a force tending to impart rotation to the first panel receiving portion 220. The tines or serrations 228 have sharp points which facilitate digging into the first panel 6. Since the tines 228 are inclined towards the bight 226, the first panel receiving portion 220 can be inserted onto the edge of the first panel 6. During insertion the tines or serrations 228 will be deflected inwardly. It can readily be seen that it would require a greater extraction force to remove the first panel receiving portion 220 from the first panel 6 than the force required to insert the first panel receiving portion 220 onto the first panel 6.

The second panel receiving portion 240 has a pair of oppositely facing walls 242 and 224 extending from a central bight 246. Both electrical and mechanical interconnection to the second panel 8 is established by tines or serrations 248 formed inwardly along the edges 250 of wall 224 of the second panel receiving section 240. These tines or serrations 248 protrude inwardly from the wall 224 and form an inclined gripping engagement with the second panel 8. Each tine 248 is inclined inwardly relative to the wall 224 and extends toward the bight 246. The tines 248 have a greater retention force when subjected to a straight pull exerted on the second panel receiving portion 240 than when subjected to a force tending to impart rotation to the second panel receiving portion 240. The tines or serrations 248 have sharp points which facilitate digging into the second panel 8. Since the tines 248 are inclined towards the bight 246, the second panel receiving portion 240 can be inserted onto the edge of the second panel 8. During insertion the tines or serrations 248 will be deflected inwardly. It can readily be seen that it would require a greater extraction force to remove the second panel receiving portion 240 from the second panel 8 than the force required to insert the second panel receiving portion 240 onto the second panel 8.

As is best shown in FIG. 12, the first panel receiving portion 220 and the second panel receiving section 240 have wall 224 in common. However in this embodiment, the wall 224 extends from the first panel receiving portion 220 to the second panel receiving section and has the connecting portion 258 therebetween. Bight 226 extends from a first edge 232 of the wall 224. The open end of the first panel receiving recess 236 is formed in the first panel receiving portion 220 opposite the bight 226. Bight 246 extends from a second edge 254 of the wall 224. The open end of the second panel receiving recess 256 is formed in the second panel receiving portion 240 opposite the bight 246. As best shown in FIGS. 11 and 12, the open end of the first panel receiving recess 236 and the open end of the second panel receiving recess 256 face in opposite directions. Although the open ends face in opposite directions in the embodiment shown, other configurations are possible without departing from the scope of the invention.

Figure 13:
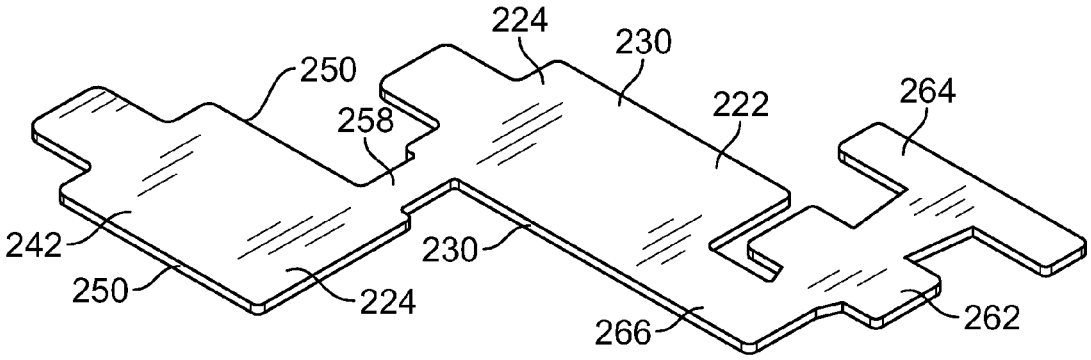
FIG. 13 is a top perspective view of blank of the grounding clip of FIG. 11 prior to forming.

As best shown in FIGS. 11 through 13, the wire contact section 260 extends from the wall 222 of the first panel receiving portion 220. The wire contact section 260 has a crimp section 262 with a strain relief section 264 of conventional construction suitable for establishing an electrical connection to the stripped end of an insulated wire 4. In this embodiment, the contact section 260 has a transition section 266 which extends from the wall 222 to the crimp section 262. The transition section 266 allows the crimp section 262 and the strain relief section 264 to be spaced from the wall 222. Additionally, the transition section 266 allows the crimp section 262 and the strain relief section 264 to have their longitudinal axis positioned in a line which is essentially parallel to the longitudinal axis of the bight 226. This configuration is generally referred to as a right angled version. No portion of the wire contact section 260 extends into the extended space of the first panel receiving recess 236. Consequently, neither the wire contact section 260 nor the wire 4 will interfere with the insertion of the first panel 6 into the first panel receiving recess 236.

Figure 14:
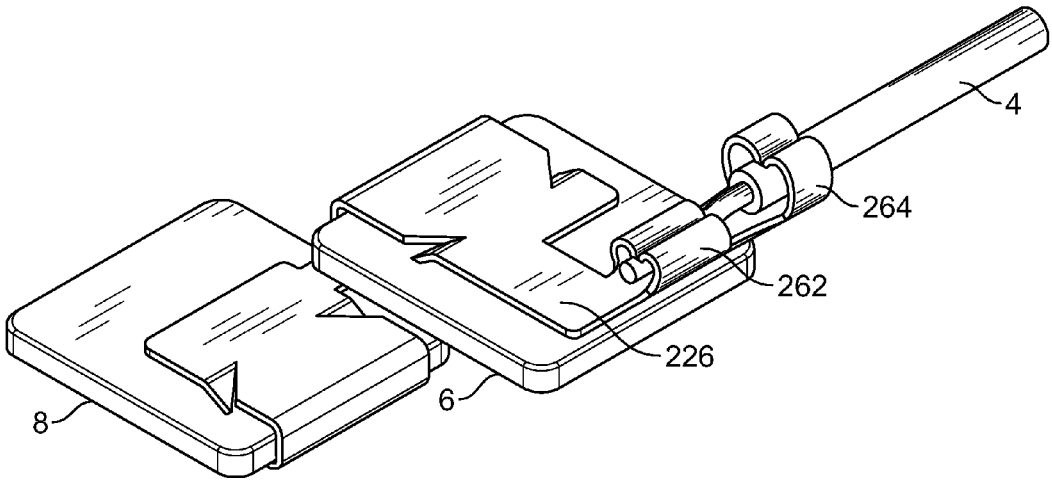
FIG. 14 is a top perspective view of the grounding clip of FIG. 11 showing a wire and panels terminated thereto.
Figure 15:
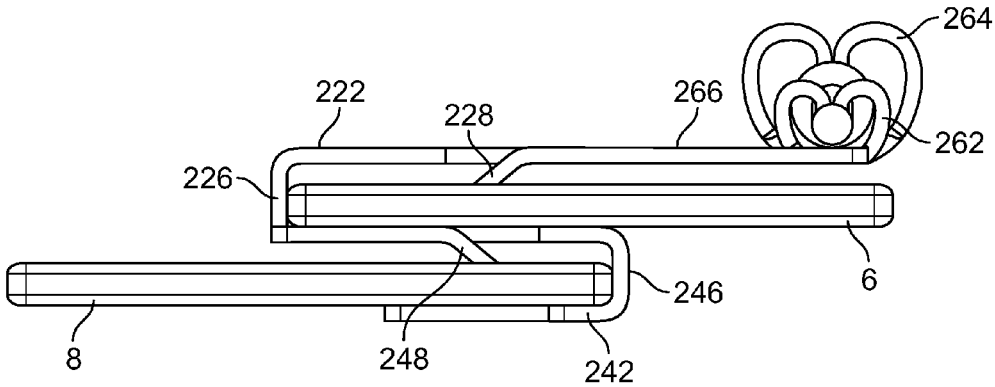
FIG. 15 is a side view of the grounding clip of FIG. 12 showing a wire and panels terminated thereto.

Referring to FIGS. 14 and 15, the ground wire 4, the first panel 6 and the second panel 8 are positioned in electrical engagement with the grounding clip 202. Crimp section 262 is crimped to the ground wire 4, placing the grounding clip 202 in electrical engagement with the ground wire 4. Strain relief section 264 engages the ground wire 4 to provide a strain relief to the ground wire 4. The tines 228, 248 engage the panels 6, 8 respectively to provide a grounding path therebetween. As the panels 6, 8 are inserted into the grounding clips 202, the tines 228, 248 will exert pressure on the surfaces of the panels 6, 8 thereby providing a wiping action as the insertion occurs to remove any contamination on the surfaces of the panels 6, 8. This provides a reliable electrical connection between the tines 228, 248 and the panels 6, 8.

Figure 16:
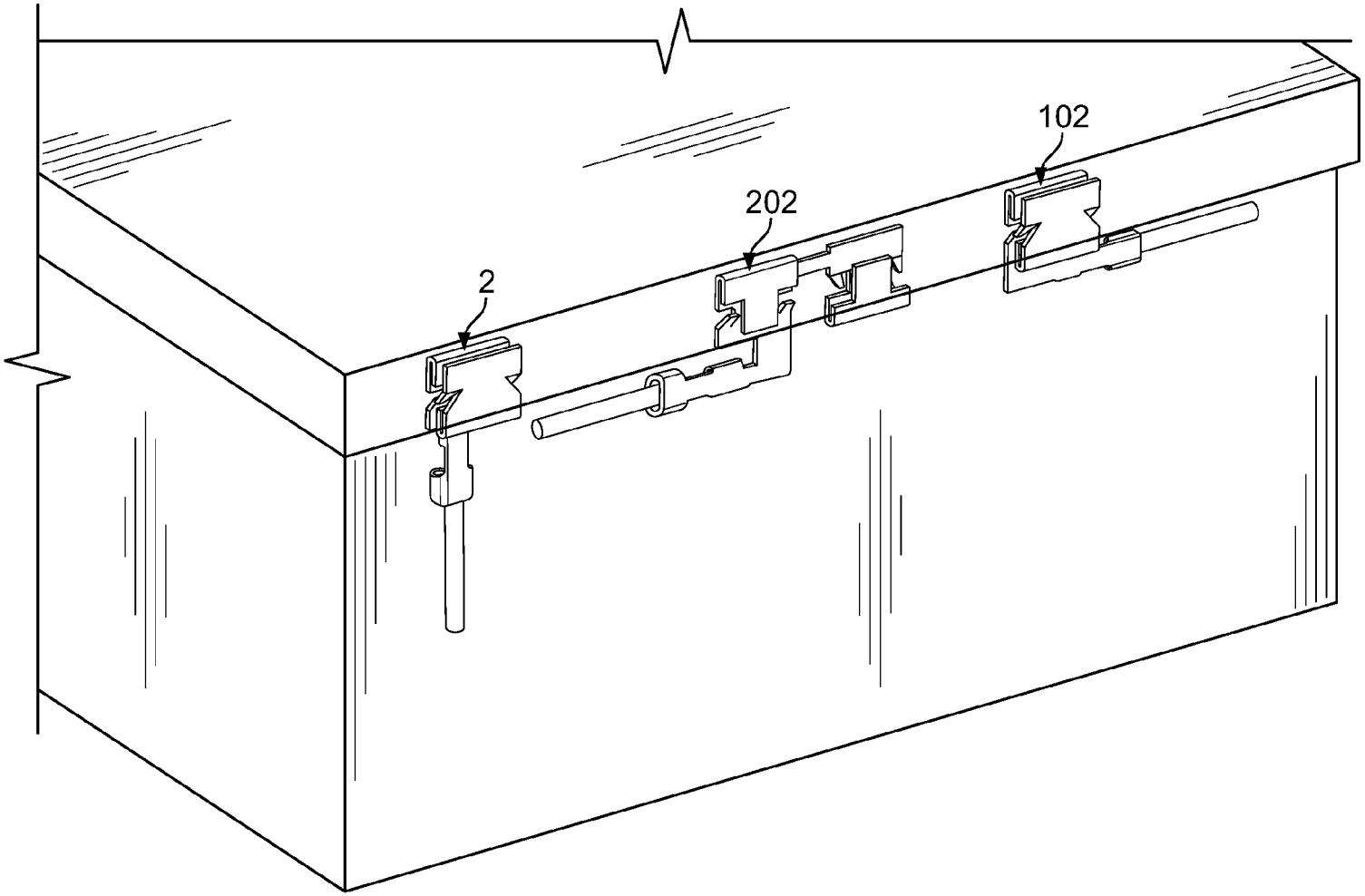
FIG. 16 is an illustrative partial perspective view of a ballast with three grounding clips therein.

Referring to FIG. 16, an example of the use of this type of ground clip is shown. A ballast 90 is represented having a ballast can 92 and ballast lid 94. For purposes of illustration, all three grounding clips 2, 102, 202 are shown terminated to a wire 4, a first panel or ballast can 92 and a second panel or ballast lid 94. In the field, only one grounding clip would be used for this type of application. In each case, the wire, the ballast can and the ballast lid are ground by the use of the respective grounding clip 2, 102, 202.

While the invention has been described with reference to a preferred embodiment, it will be understood by those skilled in the art that various changes may be made and equivalents may be substituted for elements thereof without departing from the scope of the invention. For example, the orientation of the respective panel receiving portions and the orientation of the wire contact sections can be varied and the method of terminating the wire can be changed without departing from the scope of the invention. The number of panel receiving portions can also be increased if it is desirable to have more than two panels grounded to the ground wire. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A grounding clip comprising:

a wire terminating section for terminating a grounding wire thereto;

a first panel receiving portion for terminating a first panel therein, the first panel receiving portion having tines which are inclined inwardly into the first panel receiving portion;

a second panel receiving portion for terminating a second panel therein;

wherein the wire terminating section, the first panel receiving portion and the second panel receiving portion conduct current thereacross to provide grounding between components electrically connected thereto.

2. The grounding clip as recited in claim 1 wherein the first panel receiving portion has a first wall and an oppositely facing second wall, the first wall and the oppositely facing second wall extending from a bight portion.

3. The grounding clip as recited in claim 2 wherein the tines extend inwardly from proximate edges of the first wall, the tines being inclined inwardly relative to the first wall and extending toward the bight portion.

4. The grounding clip as recited in claim 3 wherein the tines have sharp points to facilitate making an electrical connection with a first panel when the first panel is inserted into the first panel receiving portion.

5. The grounding clip as recited in claim 1 wherein the second panel receiving portion has a first wall and an oppositely facing second wall, the first wall and the oppositely facing second wall extending from a bight portion.

6. The grounding clip as recited in claim 5 wherein second tines extend inwardly from proximate edges of the first wall, the tines being inclined inwardly relative to the first wall and extending toward the bight portion.

7. The grounding clip as recited in claim 6 wherein the second tines have sharp points to facilitate making an electrical connection with a second panel when the second panel is inserted into the second panel receiving portion.

8. The grounding clip as recited in claim 1 wherein the first panel receiving portion has a first outside wall and an oppositely facing inside wall, the outside wall and the inside wall extending from a first bight portion, the second panel receiving portion having a second outside wall and the oppositely facing inside wall, the second outside wall and the inside wall extending from a second bight portion, the first bight portion extending from a first edge of the inside wall and the second bight portion extending from an oppositely facing second edge of the inside wall.

9. The grounding clip as recited in claim 8 wherein the wire terminating section extends from the first outside wall of the first panel receiving portion.

10. The grounding clip as recited in claim 9 wherein the wire terminating section has a transition section which spaces a crimp section of the wire terminating section from the first outside wall.

11. The grounding clip as recited in claim 8 wherein the inside wall has a connecting portion which extends between the first panel receiving portion and the second panel receiving portion.

12. A grounding clip comprising:

a wire terminating section for terminating a grounding wire thereto;

a first panel receiving portion for terminating a first panel therein, the first panel receiving portion having a first outside wall and an oppositely facing inside wall, the outside wall and the inside wall extending from a first bight portion;

a second panel receiving portion for terminating a second panel therein, the second panel receiving portion having a second outside wall and the oppositely facing inside wall, the second outside wall and the inside wall extending from a second bight portion;

the first bight portion extending from a first edge of the inside wall and the second bight portion extending from an oppositely facing second edge of the inside wall;

wherein the wire terminating section, the first panel receiving portion and the second panel receiving portion conduct current thereacross to provide grounding between components electrically connected thereto.

13. The grounding clip as recited in claim 12 wherein the inside wall has a connecting portion which extends between the first panel receiving portion and the second panel receiving portion.

14. The grounding clip as recited in claim 12 wherein tines extend inwardly from proximate edges of the first outside wall and the second outside wall, the tines being inclined inwardly relative to the respective first outside wall and the second outside wall and extending toward the respective first bight portion and second bight portion.

15. The grounding clip as recited in claim 14 wherein the tines have sharp points to facilitate making an electrical connection with a respective first panel and a respective second panel when the first panel is inserted into the first panel receiving portion and the second panel is inserted into the second panel receiving portion.

16. The grounding clip as recited in claim 12 wherein tines extend inwardly from proximate edges of the inside wall, the tines being inclined inwardly relative to the inside wall and extending toward the respective first bight portion and second bight portion.

17. The grounding clip as recited in claim 12 wherein the wire terminating section extends from the first outside wall of the first panel receiving portion.

18. The grounding clip as recited in claim 17 wherein the wire terminating section has a transition section which spaces a crimp section of the wire terminating section from the first outside wall.

* * * * *